United States Patent [19]

Mammino

[11] 3,951,654

[45] Apr. 20, 1976

[54] METHOD FOR ENHANCEMENT IN THE RATE AND EFFICIENCY OF PHOTODISCHARGE OF ELECTROSTATOGRAPHIC IMAGING MEMBERS COMPRISING PHTHALOCYANINE

[75] Inventor: Joseph Mammino, Penfield, N.Y.

[73] Assignee: Xerox Corporation, Stamford, Conn.

[22] Filed: June 20, 1974

[21] Appl. No.: 481,014

[52] U.S. Cl. ..... 96/1.6; 252/501

[51] Int. Cl.[2] ..... G03G 5/09

[58] Field of Search ..... 96/1.6, 1.5; 252/501; 260/314.5

[56] References Cited

UNITED STATES PATENTS

| | | | |
|---|---|---|---|
| 3,271,144 | 9/1966 | Clausen et al. | 96/1 |
| 3,725,395 | 4/1973 | Siegrist et al. | 96/1.5 |
| 3,816,118 | 6/1974 | Byrne | 96/1.5 |

*Primary Examiner*—David Klein
*Assistant Examiner*—Judson R. Hightower
*Attorney, Agent, or Firm*—James J. Ralabate; James P. O'Sullivan; John H. Faro

[57] ABSTRACT

Method for enhancing both the rate and completeness of discharge of a photoconductive insulating layer comprising phthalocyanine pigments. Such enhancement is achieved by incorporation within such layer of from about 0.1 to about 10 weight percent, based upon phthalocyanine content, of at least one charge transport sensitizer compound of the formula wherein $R_1$ is alkyl of 1–6 carbon atoms;

$R_2$ is aryl, aralkyl, p-alkylaminophenyl, or substituted p-dialkylaminophenyl;

$R_4$ represents a hydrocarbon diradical making up the balance of an aromatic ring system;

$R_3$ is alkyl, aryl, alkaryl, heterocyclo, amino, alkyl substituted amino, nitro, alkoxy or halogen;

X is sulfur, oxygen or selenium; and

A is a monovalent or divalent anion.

24 Claims, 1 Drawing Figure

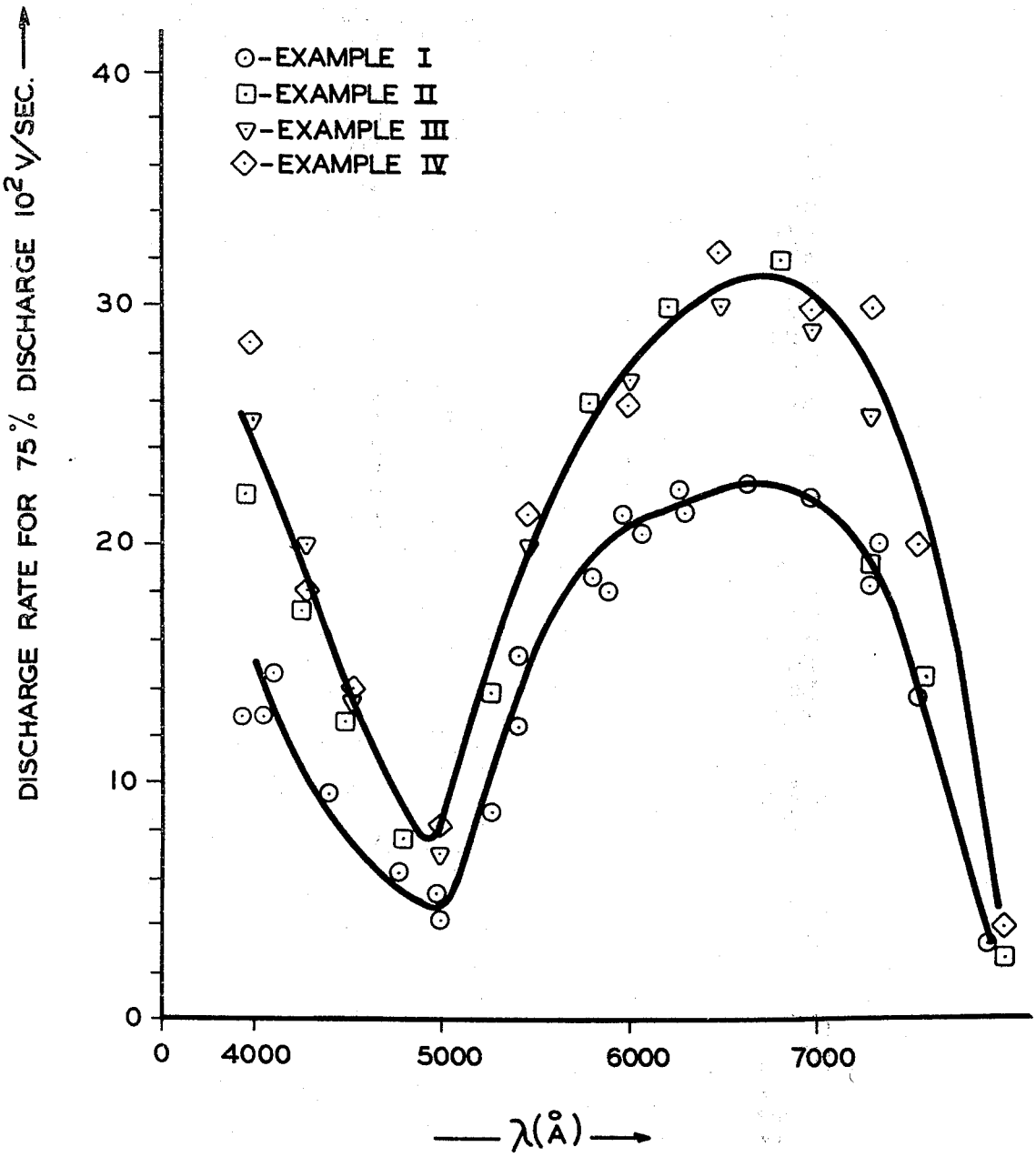
⊙-EXAMPLE I
⊡-EXAMPLE II
▽-EXAMPLE III
◇-EXAMPLE IV
DISCHARGE RATE FOR 75% DISCHARGE $10^2$ V/SEC.
40
30
20
10
0
0
4000
5000
6000
7000
λ(Å)

METHOD FOR ENHANCEMENT IN THE RATE AND EFFICIENCY OF PHOTODISCHARGE OF ELECTROSTATOGRAPHIC IMAGING MEMBERS COMPRISING PHTHALOCYANINE

BACKGROUND OF THE INVENTION

1. Field of the Invention

This invention relates to a method and a composition prepared according to said method. More specifically, this invention involves a method for enhancement in both the rate and completeness of discharge of electrostatographic imaging members comprising phthalocyanine pigments.

2. Description of Prior Art

The formation and development of images on the imaging surfaces of photoconductive materials by electrostatic means is well known. The best known of the commercial processes, more commonly known as xerography, involves forming a latent electrostatic image on the imaging surface of an imaging layer by first uniformly electrostatically charging the surface of the imaging layer in the dark, followed by exposing this electrostatically charged surface to a light and shadow image. The light struck areas of the imaging layer are thus rendered relatively conductive and the electrostatic charge selectively dissipated in these irradiated areas. After the photoconductor is exposed, the latent image on this image bearing surface is rendered visible by development with finely divided colored electroscopic materials, known in the art as "toner".

In order to be able to develop the latent image on the photoconductive insulating layer, the difference between the potential in the exposed and unexposed areas of this layer (this difference hereinafter referred to as the "contrast potential") must be sufficient to permit the electroscopic toner particles to discriminate between these two areas, and thus, be preferentially attracted to only one of them. Subsequent to development and transfer of the image, the imaging surface of the photoconductive insulating layer is cleansed of toner residues and its surface potential neutralized prior to recycling. Under ideal conditions, the sensitizing surface charge is substantially completely discharged between cycles. In the event of a failure to completely dissipate the surface potential, due to, for example, trapping of charge carriers in the bulk of the photoconductive insulating layer, the charge acceptance of the photoconductive insulating layer in successive copying cycles will be appreciably reduced, thus, reducing the maximum attainable contrast potential.

The inherent insulating properties of the materials used in preparation of photoconductive insulating layers can also affect both the rate and completeness of discharge of a sensitizing surface charge. Where the photoconductive insulating layer comprises phthalocyanine pigments dispersed in an insulating binder, completeness of discharge is apparently time dependent. In the event that the cycling interval of the photoreceptor is too rapid to permit completeness of dissipation of a sensitizing surface charge, the residual charge remaining on and within the imaging layer will be relatively high and thus maximum attainable contrast potential will be reduced upon recycling.

Accordingly, it is the object of this invention to remove the above as well as related deficiencies in the prior art.

More specifically, it is the primary object of this invention to provide a method for enhancing the efficiency of phthalocyanine based photoreceptors in rapidly cycling electrostatographic imaging systems.

It is another object of this invention to provide a method for enhancing the completeness of photodischarge of an electrostatographic imaging member comprising phthalocyanine pigments.

It is yet another object of this invention to provide a method for enhancing the rate of photodischarge of an electrostatographic imaging member comprising phthalocyanine pigments.

Still yet another object of this invention is to provide an electrostatographic imaging member having improved efficiency and completeness of photodischarge and an imaging process utilizing said imaging member.

SUMMARY OF THE INVENTION

The above and related objects are achieved by providing an electrostatographic imaging member comprising a photoconductive insulating layer containing phthalocyanine pigments and from about 0.1 to about 10 weight percent, based upon phthalocyanine content, of at least one charge transport sensitizer compound of the formula

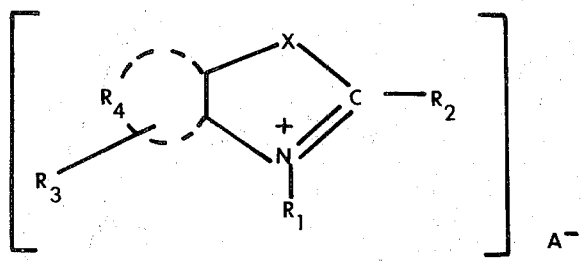

wherein $R_1$ is alkyl of 1–6 carbon atoms;

$R_2$ is aryl, aralkyl, p-alkylaminophenyl, or substituted p-dialkylaminophenyl;

$R_4$ represents a hydrocarbon diradical making up the balance of an aromatic ring system;

$R_3$ is alkyl, aryl, alkaryl, heterocyclo, amino, alkyl substituted amino, nitro, alkoxy or halogen;

X is sulfur, oxygen or selenium; and

A is a monovalent or divalent anion.

In a preferred embodiment of this invention, the phthalocyanine pigment and the sensitizer compound are intimately physically dispersed by mechanical attrition prior to their dispersion within a polymeric binder.

DESCRIPTION OF THE INVENTION INCLUDING PREFERRED EMBODIMENTS

According to this method, suffficient charge transport sensitizer compound is associated with the phthalocyanine pigment contained within a photoconductive insulating layer to effectively enhance both the rate and completeness of discharge of a sensitizing surface charge. Good results are obtained wherein the relative concentration of charge transport sensitizer compound to phthalocyanine pigment is within the previously stated range; however, as the upper concentration of sensitizer exceeds 5 weight percent, the extent of crystallization of sensitizer compound within the photoconductive composition tends to increase. This is permissible provided such crystallization does not materially adversely impair the charge storage characteristics and discharge properties of the resultant film.

The phthalocyanine compounds suitable for use in this invention include any of the metal-free and metal-containing phthalocyanine pigments available in the art. The polymorphic form of a pigment is not believed to be a factor in practicing this invention. In one of the preferred embodiments of this invention, the sensitizer compound can be added to the alpha form of the phthalocyanine pigment prior to its conversion to the corresponding beta polymorph. Phthalocyanine pigments are generally readily commercially available and where unavailable can be prepared by techniques and with apparatus disclosed in both the technical and patent literature. See Moser and Thomas, *Phthalocyanine Compounds*, ACS Monograph Series, Reinhold Publishing Corp., New York City (1963); U.S. Pat. No. 3,492,309 — synthesis of metal-free phthalocyanine; U.S. Pat. No. 3,492,308 — synthesis of metal-free phthalocyanine; U.S. Pat. No. 3,509,146 — synthesis of phthalocyanine and heterocyclic analogues thereof; U.S. Pat. No. 3,657,272 — synthesis of the X-form of metal-free phthalocyanine; U.S. Pat. No. 3,594,163 — method for converting the alpha form of phthalocyanine to the X-poly(morph); and U.S. Pat. No. Re 27,117 (original U.S. Pat. No. 3,357,989) — synthesis of the X-form of metal-free phthalocyanine.

The sensitizer compounds suitable for use in this invention can include one or more of the compounds embraced by the formula set forth hereinabove. Sensitizers which are especially suitable for use in this invention include 2-(4-dimethylaminophenyl)-3, 6-dimethyl benzothiazolium chloride, (commercially available as Setoflavin-T from CIBA-Geigy Chemical Corporation) and its analogues. These sensitizers, although generally classified as dyes, are not regarded as photoconductors and at the preferred concentration previously set forth for the use of such materials do not apparently participate in photogeneration of charge carriers. It is believed that these sensitizers reduce the interparticulate barriers to hole transport between phthalocyanine crystals, thus, allowing for the more complete and efficient charge transport of carriers through the photoconductive composition.

Any of the binders commonly used in preparation of electrophotographic imaging members are suitable for use in this invention. Representative of such binder materials are the poly (olefins), poly(styrene), poly(methylmethacrylate), poly(vinylchoride), poly(siloxane), poly(vinylcarbazoles), poly(vinylpyrene), mixtures (e.g. U.S. Pat. No. 3,640,710), blends and copolymers thereof. A number of the above binders are commercially available and where unavailable can be prepared by techniques disclosed in the literature.

The phthalocyanine pigment and charge transport sensitizer compound can be associated with one another by mechanical blending or dispersion in a suitable fluid vehicle. The relative concentration of the phthalocyanine pigment in a photoconductive insulating layer is known to generally range from as little as 0.1 percent to in excess of about 50 percent by weight. Generally, as the concentration of phthalocyanine pigments to binder exceed 50 weight percent, the charge storage capability of the resulting composition is adversely affected. Where such high concentrations of phthalocyanine pigments are to be used in a photoconductive composition, it is generally required that the charge storage capacity of the resulting composite be supplemented by the addition of an overcoating which is capable of prevention of injection of a sensitizing surface charge into the bulk of the photoconductive composition. Such overcoating materials can either provide shallow trapping of the sensitizing surface charge, U.S. Pat. No. 2,901,348; or provide an independent charge storage function as do the overcoatings disclosed in U.S. Pat. No. 3,234,019 (to Hall), U.S. Pat. No. 3,653,064 (to Inoue), or U.S. Pat. No. 3,708,291 (to Kinoshita). Once having combined the phthalocyanine pigment, the charge transport sensitizer compound and the insulating binder resin in their proper relative proportions the resulting mixture can be solvent cast or coated on a suitable conductive substrate. Any of the conductive substrates traditionally used in preparation of electrophotographic imaging members can be coated with the photoconductive composition described above. Representative of materials suitable for use as conductive substrates include aluminum, chromium, brass, nickel, stainless steel, metallized plastic films, metal coated plastic films (e.g. aluminized Mylar) and tin oxide coated glass plates (NESA glass).

The amount of composition transferred to the conductive substrate can vary within the range of thicknesses generally disclosed for electrophotographic imaging members. For example, in conventional electrophotographic imaging systems, the thickness of the photoconductive layer can range from as thin as 0.1 microns to in excess of about 60 microns. Thicker layers, on the order of about 150 to 200 microns, are traditionally used in xeroradiographic imaging members. Where a charge storage insulating layer overcoats the photoconductive layer, the relative thickness of the photoconductive layer can be reduced since it need not be capable of independently sustaining the sensitizing surface charge.

The Examples which follow further define, describe and illustrate the compositions, articles and methods of this invention. Apparatus and techniques used in preparation and evaluation of the electrophotographic members prepared in these Examples are standard or as hereinbefore described. Parts and percentages appearing in such Examples are by weight unless otherwise indicated.

EXAMPLE I

A photoconductive composition is prepared according to the procedures described in U.S. Pat. No. 3,640,710 by combining the materials specified hereinafter in a ball-milling jar one-third full of half-inch diameter flint pebbles and roller milling the contents of the jar for about 20 hours at 140 rpm. The composition contains the following:

4.8 parts Chlorowax - 70 LP (a chlorinated parafin, available from Diamond Shamrock Corp.)

4.8 parts alkyd-acrylate resin (Arotap EP8911-7-7 available from ADM chemicals)

1.6 parts silicone resin (Silicone Resin Sr-82, available from General Electric Corp.)

0.7 parts alpha metal free phthalocyanine (available from BASF Corp.)

During this ball-milling procedure, the phthalocyanine pigment is converted from the alpha to the beta polymorph. The above composition is separated from the flint pebbles by filtration through a 200 mesh nylon screen, the viscosity of the dispersion adjusted (if necessary, by the addition of toluene to within a viscosity range of from about 150 to 175 centipoise — measured at 24°C on a Brookfield RVK viscometer, No. 2 spindle, speed setting = 50), and the recovered dispersion draw-down coated with a No. 22 wire on a 5 mil aluminum sheet. The resulting coating is force air dried for 60 seconds at 125°C to minimize settling of the pigment within the binder. Dry film thickness of the coating is estimated at about 6–7 $\mu$m. The spectral response characteristics of this composition are shown in FIG. 1.

EXAMPLES II – IV

The procedures of Example I are repeated except for the addition of the thiazolium dye salt, Setoflavin-T, (available from CIBA-Geigy Chemical Corporation), to the photoconductive composition.

| Example No. | Concentration of Setoflavin-T |
|---|---|
| II | 0.0007 parts |
| III | 0.0049 parts |
| IV | 0.0126 parts |

The spectral response curves for each of the above compositions are plotted in FIG. 1. Comparison of the sensitized compositions (Examples II, III and IV) with the unsensitized composition (Example I) shows a twofold increase in sensitivity throughout the beta-phthalocyanine spectrum for the sensitized coatings.

EXAMPLE V

The procedures of Example IV are repeated except for the omission of the phthalocyanine pigment from the composition. Evaluation of the spectral response characteristics of the resulting film in the manner described above indicates this film to be non-photoconductive.

As is apparent from the above data, the combination of charge transport sensitizer compounds and phthalocyanine pigments results in a synergistic effect whereby the efficiency of photoresponse of the phthalocyanine pigment is substantially enhanced above the unsensitized composition. This latter Example also indicates that the photoresponse is not merely additive since the composition containing the thiazolium dye salt is non-photoresponsive in the absence of phthalocyanine pigment.

EXAMPLES VI – XIV

The following analogues of Setoflavin-T are substituted for the sensitizer of Example IV.

| Example No. | Analogues of Setoflavin-T |
|---|---|
| VI | 2-(p-N,N-dimethylaminophenyl)-3-ethyl-9-naphthothiazolium iodide |
| VII | 2-(p-N,N-dimethylaminophenyl)-alpha-naphthoxazole |
| VIII | 3-methylbenzothiazolium iodide |
| IX | 3-methylbenzothiazolium-p-toluene sulfonate |
| X | 2-methylbenzoxazolium ethiodide |
| XI | 2-methylbenzothiazolium ethiodide |
| XII | 2-(p-N,N-dimethylaminophenyl)-benzoxazolium ethiodide |
| XIII | 2-(p-N,N-dimethylaminophenyl)-alpha-naphthoxazolium ethiodide |
| XIV | 2-(p-nitrophenyl)benzoxazole |

In each case, spectral response enhancement similar to that observed in Example IV is realized with the sensitizers listed above.

What is claimed is:

1. A composition consisting essentially of phthalocyanine pigment and a charge transport sensitizer effective amount of at least one compound of the formula

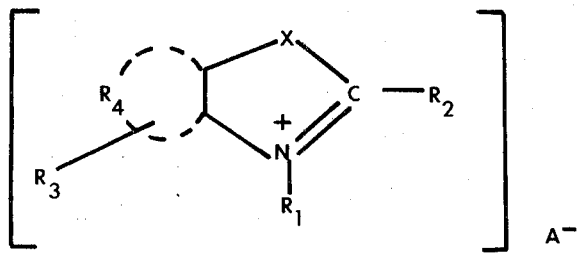

wherein $R_1$ is alkyl of 1–6 carbon atoms;

$R_2$ is aryl, aralkyl, p-alkylaminophenyl, or substituted p-dialkylaminophenyl;

$R_4$ represents a hydrocarbon diradical making up the balance of an aromatic ring system;

$R_3$ is alkyl, aryl, alkaryl, heterocyclo, amino, alkyl substituted amino, nitro, alkoxy or halogen;

X is sulfur, oxygen or selenium; and

A is a monovalent or divalent anion;

the weight ratio of phthalocyanine pigment to charge transport sensitizer compound in the composition ranging from about 99.9:0.1 to about 90:10.

2. The composition of claim 1, wherein the sensitizer compound is 2-(4-dimethylaminophenyl) -3,6-dimethyl-benzothiazolium chloride.

3. The composition of claim 1, wherein the sensitizer compound is 2-(p-N,N-dimethylaminophenyl)-3-ethyl-9-naphthothiazolium iodide.

4. The composition of claim 1, wherein the sensitizer compound is 2-(p-N,N-dimethylaminophenyl)-alpha-naphthoxazole.

5. The composition of claim 1, wherein the sensitizer compound is 3-methylbenzothiazolium iodide.

6. The composition of claim 1, wherein the sensitizer compound is 3-methylbenzothiazolium-p-toluene sulfonate.

7. The composition of claim 1, wherein the sensitizer compound is 2-methylbenzoxazolium ethiodide.

8. The composition of claim 1, wherein the sensitizer compound is 2-methylbenzothiazolium ethiodide.

9. The composition of claim 1, wherein the sensitizer compound is 2-(p-N,N-dimethylaminophenyl)-benzoxazolium ethiodide.

10. The composition of claim 1, wherein the sensitizer compound is 2-(p-N,N-dimethylaminophenyl)-alpha-naphthoxazolium ethiodide.

11. The composition of claim 1, wherein the sensitizer compound is 2-(p-nitrophenyl)benzoxazole.

12. A photoconductive composition comprising a. an insulating binder resin;

b. a photoconductive effective amount of phthalocyanine pigment; and c. a charge transport sensitizer effective amount of at least one compound of the formula

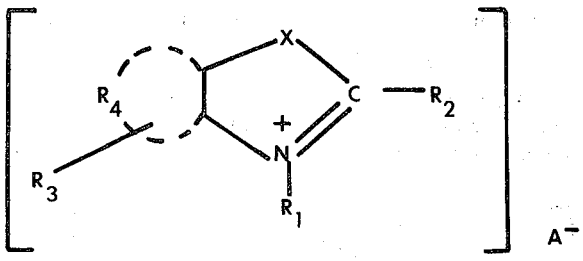

wherein $R_1$ is alkyl of 1–6 carbon atoms;

$R_2$ is aryl, aralkyl, p-alkylaminophenyl, or substituted p-dialkylaminophenyl;

$R_4$ represents a hydrocarbon diradical making a the balance of an aromatic ring system;

$R_3$ is alkyl, aryl, alkaryl, heterocyclo, amino, alkyl substituted amino, nitro, alkoxy or halogen;

X is sulfur, oxygen or selenide; and

A is a monovalent or divalent anion;

the weight ratio of phthalocyanine pigment to charge transport sensitizer compound in the composition ranging from about 99.9:0.1 to about 90:10.

13. The photoconductive composition of claim 12, wherein the sensitizer is 2-(4-dimethylaminophenyl)-3,6-dimethyl-benzothiazolium chloride.

14. The photoconductive composition of claim 12, wherein the sensitizer is 2-(p-N,N-dimethylaminophenyl)-3-ethyl-9-naphthothiazolium iodide.

15. The photoconductive composition of claim 12, wherein the sensitizer is 2-(p-N,N-dimethylaminophenyl)-alpha-naphthoxazole.

16. The photoconductive composition of claim 12, wherein the sensitizer is 3-methylbenzothiazolium iodide.

17. The photoconductive composition of claim 12, wherein the sensitizer is 3-methylbenzothiazolium-p-toluene sulfonate.

18. The photoconductive composition of claim 12, wherein the sensitizer is 2-methylbenzoxazolium ethiodide.

19. The photoconductive composition of claim 12, wherein the sensitizer is 2-methylbenzothiazolium ethiodide.

20. The photoconductive composition of claim 12, wherein the sensitizer is 2-p-N,N-dimethylaminophenyl)-benzoxazolium ethiodide.

21. The photoconductive composition of claim 12, wherein the sensitizer is 2-(p-N,N-dimethylaminophenyl)-alpha-naphthoxazolium ethiodide.

22. The photoconductive composition of claim 12, wherein the sensitizer is 2-(p-nitrophenyl)benzoxazole.

23. A method for enhancement in the efficiency of a photoconductive insulating layer comprising an insulating binder and phthalocyanine pigment, said method comprising:

admixing the phthalocyanine pigment with a charge transport sensitizer effective amount of at least one compound of the formula

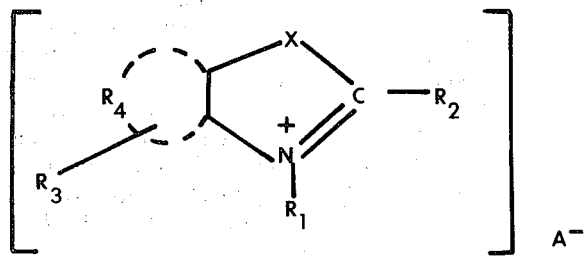

wherein $R_1$ is alkyl of 1–6 carbon atoms;

$R_2$ is aryl, aralkyl, p-alkylaminophenyl, or substituted p-dialkylaminophenyl;

$R_4$ represents a hydrocarbon diradical making up the balance of an aromatic ring system;

$R_3$ is alkyl, aryl, alkaryl, heterocyclo, amino, alkyl substituted amino, nitro, alkoxy or halogen;

X is sulfur, oxygen or selenium; and

A is a monovalent or divalent anion;

the relative weight ratio of phthalocyanine pigment to charge transport sensitizer compound ranging from about 99.9:0.1 to about 90:10.

24. In an electrophotographic imaging member having a conductive substrate and a photoconductive layer comprising phthalocyanine pigment in an insulating binder resin, the improvement comprising:

the inclusion within said photoconductive layer of a charge transport sensitizer effective amount of at least one compound of the formula

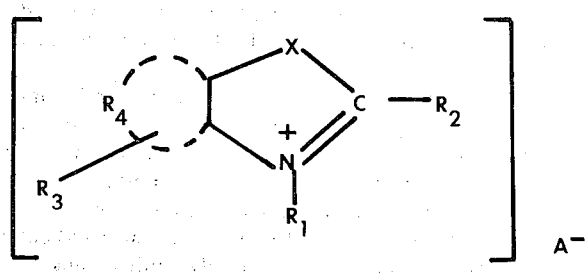

wherein $R_1$ is alkyl of 1–6 carbon atoms;

$R_2$ is aryl, aralkyl, p-alkylaminophenyl, or substituted p-dialkylaminophenyl;

$R_4$ represents a hydrocarbon diradical making up the balance of an aromatic ring system;

$R_3$ is alkyl, aryl, alkaryl, heterocyclo, amino, alkyl substituted amino, nitro, alkoxy or halogen;

X is sulfur, oxygen or selenium; and

A is a monovalent or divalent anion;

the relative weight ratio of phthalocyanine pigment to charge transport sensitizer compound ranging from about 99.9:0.1 to about 90:10.

* * * * *